US010247001B2

(12) United States Patent
Yang et al.

(10) Patent No.: US 10,247,001 B2
(45) Date of Patent: Apr. 2, 2019

(54) ANTI-SPALLING BLOCKING BAR FOR LARGE CROSS-SECTION COAL GALLERY EXCAVATION WORK SURFACE AND SUPPORTING METHOD

(71) Applicant: CHINA UNIVERSITY OF MINING AND TECHNOLOGY, Xuzhou (CN)

(72) Inventors: Shengqi Yang, Xuzhou (CN); Miao Chen, Xuzhou (CN); Yuanchao Zhang, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 15/741,259

(22) PCT Filed: Aug. 31, 2016

(86) PCT No.: PCT/CN2016/097510
§ 371 (c)(1),
(2) Date: Dec. 30, 2017

(87) PCT Pub. No.: WO2017/128716
PCT Pub. Date: Aug. 3, 2017

(65) Prior Publication Data

US 2018/0195389 A1 Jul. 12, 2018

(30) Foreign Application Priority Data

Jan. 29, 2016 (CN) ..... 2016 1 0065232

(51) Int. Cl.
*E21D 19/00* (2006.01)
*E21D 11/12* (2006.01)
(Continued)

(52) U.S. Cl.
CPC ..... *E21D 21/00* (2013.01); *E21D 11/12* (2013.01); *E21D 15/00* (2013.01); *E21D 19/00* (2013.01); *E21D 21/0086* (2013.01)

(58) Field of Classification Search
CPC ..... E21D 11/12; E21D 11/152; E21D 19/00; E21D 19/02; E21D 19/04; E21D 23/0008; E21D 23/0013
(Continued)

(56) References Cited

U.S. PATENT DOCUMENTS 7,794,181 B2 * 9/2010 Hendrick ..... E21D 11/34 405/302.1
8,197,160 B2 * 6/2012 Stankus ..... E21D 11/34 405/288

FOREIGN PATENT DOCUMENTS

CN 102155246 8/2011
CN 202064977 12/2011
(Continued)

*Primary Examiner* — Frederick L Lagman
(74) *Attorney, Agent, or Firm* — Treasure IP Group, LLC

(57) ABSTRACT

Disclosed are an anti-spalling blocking bar for a large cross-section coal gallery excavation work surface and a supporting method. The anti-spalling blocking bar comprises a blocking bar (1) and a support bar (7). Both a top portion of the blocking bar and an end of the support bar are provided with screw holes (2). A steel peg (5) is provided on an outer side of a bottom portion of the blocking bar. Locking teeth (6) is provided on an inner side of a mid-upper portion of the blocking bar, and a locking catch (8) is provided on one end of the support bar. The blocking bar and support bar are secured, using the screw hole and a screw bolt, to a temporary support device. After removing coal, a tool is used to hammer the blocking bar so as to wedge the steel peg thereof into a coalface (13). The locking catch of the support bar is held within the locking teeth to support a coal heading. After use, the blocking bar and support bar can
(Continued)

be retrieved and suspended, using a hanging device, from the temporary support device. The anti-spalling blocking bar offers the advantages of easy installation, good support, reusability, convenient storage, and the like. The invention reduces the probability of personnel injury caused by coal loosening and falling from the heading, shortens the time for establishing coal heading support, and enhances a safety index and an excavation speed of a large cross-section coal gallery excavation work surface.

4 Claims, 3 Drawing Sheets

(51) Int. Cl.
*E21D 21/00* (2006.01)
*E21D 15/00* (2006.01)

(58) Field of Classification Search
USPC ..... 299/11, 12; 405/302.3
See application file for complete search history.

(56) References Cited

FOREIGN PATENT DOCUMENTS

| | | | | | |
|---|---|---|---|---|---|
| CN | 103016033 | | | 4/2013 | |
| CN | 204002872 | | | 12/2014 | |
| CN | 204312104 | | | 5/2015 | |
| CN | 105545331 | | | 5/2016 | |
| DE | 1122474 | B | * | 1/1962 | ..... E21D 11/152 |
| DE | 1165059 | B | * | 3/1964 | ..... E21D 9/06 |
| DE | 3530482 | A1 | * | 3/1987 | ..... E21D 17/06 |
| GB | 525845 | A | * | 9/1940 | ..... E21D 15/14 |

* cited by examiner

ANTI-SPALLING BLOCKING BAR FOR LARGE CROSS-SECTION COAL GALLERY EXCAVATION WORK SURFACE AND SUPPORTING METHOD

CROSS REFERENCE TO RELATED APPLICATION

This application is a national stage application of a PCT application PCT/CN2016/097510, Aug. 31, 2016, entitled "ANTI-SPALLING BLOCKING BAR FOR LARGE CROSS-SECTION COAL GALLERY EXCAVATION WORK SURFACE AND SUPPORTING METHOD" which further takes priority from a Chinese application CN 201610065232.4, filed Aug. 31, 2016. The international application and Chinese priority application are incorporated herein by reference in their entireties.

TECHNICAL FIELD

The invention relates to the technical field of mining products, especially to a wall-caving-resistant stop bar or an anti-spalling blocking bar on a driving face of a large-section coal roadway and a supporting method of the same.

BACKGROUND TECHNOLOGY

With large scaling of coal mine production equipment and great improvement of the productivity, the roadway section also gets larger and larger to satisfy the needs of normal production, transportation, ventilation and human passage. However, larger roadway section tends to increase the deformation of the roadway surrounding rock. Especially, since there are a great amount of anchor rods and ropes on the driving face of a large-section coal roadway, the heading face remains unsupported for a long period of time, thus the deformation and wall caving and/or anti-spalling (deformation, damage and collapse of the mine working face and the roadway side wall under mine pressure) problems are serious, frequently leading to safety threat to the working personnel on the driving face. Therefore, prevention and treatment of wall caving and/or anti-spalling of the heading face of the large-section coal roadway are valued increasingly.

Currently, after coal is excavated from a large-section coal roadway in China, the common way is to retain the coal body on the heading face with a heading face protection mesh, set an anchor rod below the protection mesh, press the anchor rod under the protection mesh so that the protection mesh is tightly compacted with the coal wall, and then perform permanent support. After completion of the permanent support construction, the anchor rod pressed below the protection mesh retaining the coal wall on the heading face is pulled out. The method has complex steps, the roadway driving speed is slow, the protection mesh is pressed by a single anchor rod with small protection range and poor effect, and accidents in which loose coal and rock blocks fall down and hurt persons occur frequently.

SUMMARY OF THE INVENTION

The invention aims to provide a stop bar or blocking bar which is applicable for different roadway shapes and supporting forms, is easy to use and store, and can effectively reduce wall caving and/or anti-spalling of a driving face, as well as a supporting method of the driving face of a coal roadway based on the stop bar, to solve the current problem of wall caving and/or anti-spalling of the driving face of a large-section coal roadway.

To realize the above mentioned objective, the invention adopts the following technical scheme: a wall-caving-resistant mining stop bar or anti-spalling blocking bar on a driving face of a large-section coal roadway, comprising a stop bar and a support bar matched with the stop bar; wherein bolt holes are arranged at the top of the stop bar and one end of the support bar, a steel pricker is arranged outside the bottom of the stop bar, snap teeth are arranged inside the middle and upper parts of the stop bar, and a claw which can be stuck in the snap teeth is arranged at the other end of the support bar.

Further, the steel pricker has a length of 20 cm.

A supporting method of a driving face of a large-section coal roadway according to the above-mentioned wall-caving-resistant stop bar or anti-spalling blocking bar, comprising the following steps:

1) The stop bar is fixed at the front end of a forepoling bar of a temporary supporting device of a driving face roof through coordination between the bolt holes and the bolt, and the support bar is fixed in the middle and front part of the forepoling bar through coordination of the bolt holes and the bolt; after coal is excavated, a protection mesh is stretched, the stop bar is knocked with a tool so that the steel pricker at the lower part thereof wedges into a coal wall on the heading face by pressing the protection mesh, and the protection mesh and the coal wall are compacted by the steel pricker;

2) The claw of the support bar holds against the snap teeth of the stop bar, and is fastened with a tool to realize resistance of wall caving and/or anti-spalling of the heading face; then permanent support is performed by setting an anchor rod;

3) After the permanent support is completed, the claw of the support bar is released from the snap teeth of the stop bar with a tool, and the steel pricker inserted in the coal wall is pulled out;

4) A hanging device is used to hang the stop bar on the forepoling bar, and then the next driving cycle is performed.

Further, the precise number of the wall-caving-resistant stop bars is determined according to the surrounding rock status and the large and small temporary supporting devices for the heading face section; in an area where the coal wall is unstable, wood plates or steel plates can be arranged between the stop bars as appropriate to increase the stressed area and guarantee the stability of the coal wall.

Beneficial effects: the wall-caving-resistant stop bar or anti-spalling blocking bar of the invention has advantages of easy installation, repeated use, easy storage, etc.; besides, since the steel pricker of the stop bar wedges into the coal body and the stop bar has certain active supporting force through the support bar, and temporary support of the protection mesh to the coal wall generates certain pressure; compared to the simple method of hanging the protection mesh, the device can greatly improve the stability of the coal body on the heading face, and effectively reduce accidents where crushed coal body falls down and hurt persons. Therefore, the invention can be widely applied to preventing wall caving and/or anti-spalling of the driving faces of the large-section coal roadways with various shapes and supporting methods, reduce the possibility that loose coal body on the heading face falls down and hurts persons and the time for supporting the heading face, improve the safety coefficient and the driving speed of the driving face of the large-section coal roadway, and be significant in safe and quick roadway construction.

In the figures, 1 refers to the stop bar, 2 the bolt holes, 3 the bolt, 4 the forepoling bar, 5 the steel pricker, 6 the snap teeth, 7 the support bar, 8 the claw, 9 the protection mesh, 10 the hanging device, 11 the anchor rod, 12 the wood plates and 13 the coal wall.

DETAIL DESCRIPTION OF EMBODIMENTS

The invention will be further explained in combination with the attached drawings.

The wall-caving-resistant mining stop bar on a driving face of a large-section coal roadway of the invention comprises a stop bar 1 and a support bar 7 matched with the stop bar 1.

Figure 1:
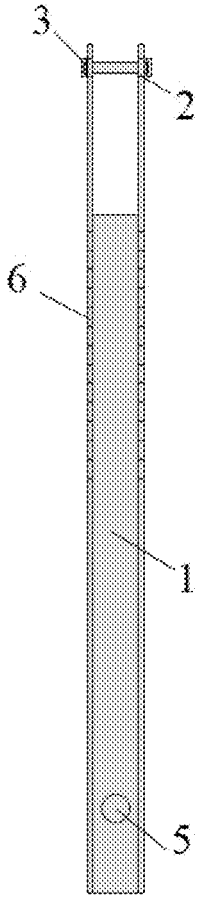
FIG. 1 is the structural diagram of the stop bar the invention.

As shown in FIG. 1, the stop bar 1 is made of a steel channel, a bolt hole 2 is formed at the top of the stop bar 1 which can be connected with a forepoling bar 4 of a temporary supporting device for a driving face roof through a bolt 3, an opening is formed in the steel plate close to the top of the stop bar 1 so that the stop bar 1 can rotate, a steel pricker 5 with a length of 20 cm is arranged outside the bottom of the stop bar 1, and snap teeth 6 are arranged inside the middle and upper parts of the stop bar 1.

Figure 2:
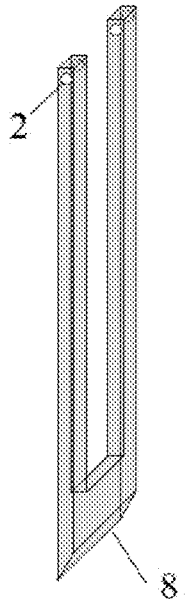
FIG. 2 is the structural diagram of the support bar of the invention.

As shown in FIG. 2, a bolt hole 2 is formed at one end of the support bar 7 which can be connected with the forepoling bar 4 through a bolt 3, and a claw 8 is arranged at the other end thereof, which can stretch into the snap teeth 6 of the stop bar.

Figure 3:
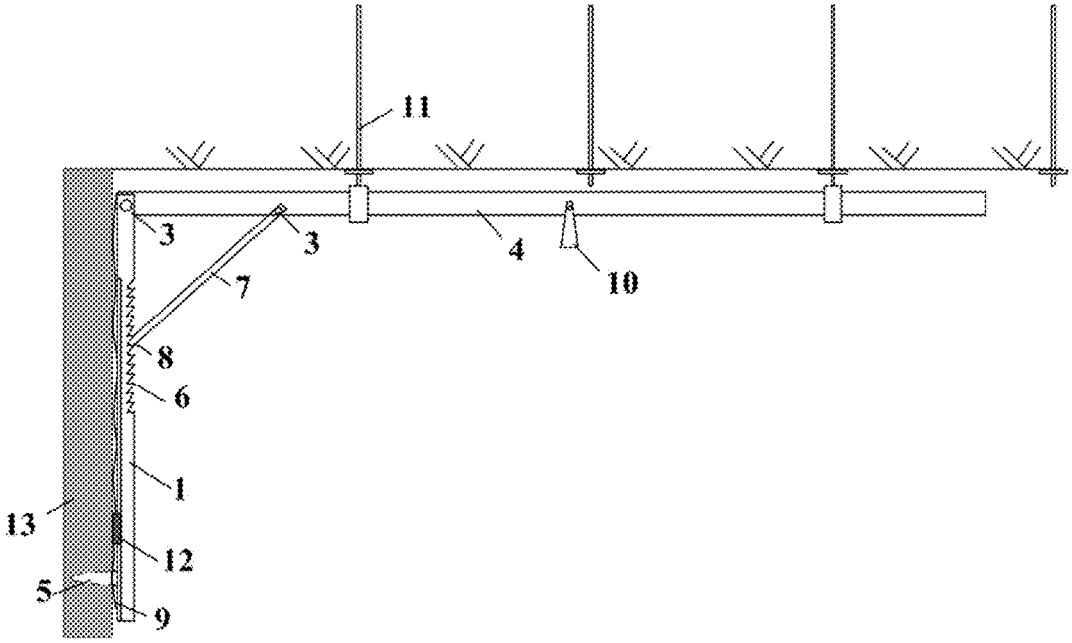
FIG. 3 is the side view of the invention in which the stop bar the support bar and the forepoling bar coordinate.
Figure 4:
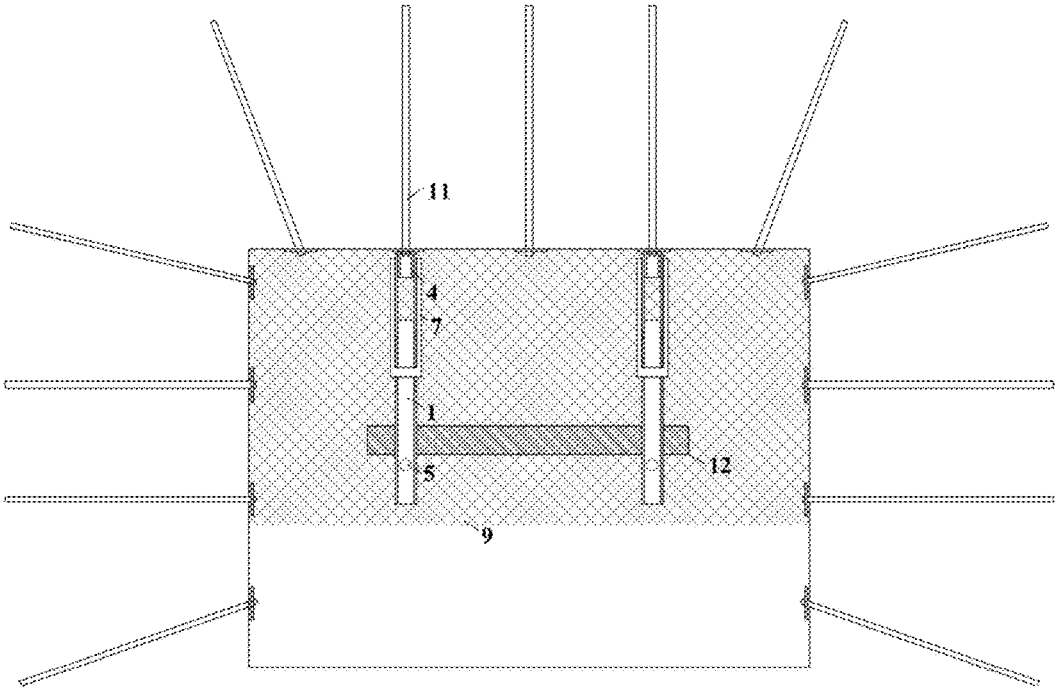
FIG. 4 is the front view of the invention in which the stop bar the support bar and the forepoling bar coordinate.

A supporting method of a driving face of a large-section coal roadway according to the above-mentioned wall-caving-resistant stop bar or anti-spalling blocking bar comprises the following steps:

1) The stop bar 1 is fixed at the front end of the forepoling bar 4 of the temporary supporting device of the driving face roof through coordination between the bolt holes 2 and the bolt 3, and the support bar 7 is fixed in the middle and front part of the forepoling bar 4 through coordination of the bolt holes 2 and the bolt 3; after coal is excavated, a protection mesh 9 is stretched, the stop bar 1 is knocked with a tool so that the steel pricker 5 at the lower part thereof wedges into a coal wall 13 on the heading face by pressing the protection mesh 9; FIGS. 3 and 4 are schematic diagrams in which the wall-caving-resistant stop bar or anti-spalling blocking bar 1 on the driving face of the large-section coal roadway of the invention, the support bar 7 and the forepoling bar 4 coordinate; in the step, the precise number of the wall-caving-resistant stop bars or anti-spalling blocking bars is determined according to the surrounding rock status and the large and small temporary supporting devices for the heading face section; in an area where the coal wall 13 is unstable, wood plates 12 or steel plates can be arranged between the stop bars 1 as appropriate to increase the stressed area and guarantee the stability of the coal wall 13;

2) The claw 8 of the support bar 7 holds against the snap teeth 6 of the stop bar 1, and is fastened with a tool to realize resistance of wall caving and/or anti-spalling of the heading face; then permanent support is performed by setting an anchor rod 11;

3) After the permanent support is completed, the claw 8 of the support bar 7 is released from the snap teeth 6 of the stop bar 1 with a tool, and the steel pricker 5 inserted in the coal wall 13 is pulled out;

4) A hanging device 10 is used to hang the stop bar 1 on the forepoling bar 4, and then the next driving cycle is performed.

The above description is preferred embodiments of the invention only. It shall be pointed out that many improvements and modifications can be made by one of ordinary skill in the technical field without departing from the principle of the invention, which shall also be regarded as falling within the scope of protection of the invention.

We claim:

1. A wall-caving-resistant mining stop bar on a driving face of a large-section coal roadway or an anti-spalling blocking bar for large cross-section coal gallery excavation work surface comprising a stop bar (1) and a support bar (7) matched with the stop bar (1);

bolt holes (2) are arranged at top of the stop bar (1) and one end of the support bar (7), a forepoling bar (4) connected at the top of the stop bar, wherein the support bar (7) is connected to the forepoling bar (4)

a steel pricker (5) is disposed on the outside of a bottom portion of the stop bar (1), snap teeth (6) are arranged inside middle and upper parts of the stop bar (1), and a claw (8), configured to be stuck in the snap teeth (6), is arranged at other end of the support bar.

2. The bar according to claim 1, characterized in that the steel pricker (5) has a length of 20 cm.

3. A supporting method of a driving face of a large-section coal roadway in the wall-caving-resistant stop bar according to claim 1, characterized in that the method comprises the following steps:

1) fixing the stop bar (1) at front end of a forepoling bar (4) of a temporary supporting device of a driving face roof through coordination between the bolt holes (2) and the bolt (3), and the support bar (7) is fixed in the middle and front part of the forepoling bar (4) through coordination of the bolt holes (2) and the bolt (3); after coal is excavated, a protection mesh (9) is stretched, the stop bar (1) is knocked with a tool so that the steel pricker (5) at lower part thereof wedges into a coal wall (13) on a heading face by pressing the protection mesh (9), and the protection mesh (9) and the coal wall (13) are compacted by the steel pricker;

2) holding the claw (8) of the support bar (7) against the snap teeth (6) of the stop bar (1), and fastening with a tool to realize resistance of wall caving of the heading face; then permanent support is performed by setting an anchor rod (11);

3) after the permanent support is completed, releasing the claw (8) of the support bar (7) from the snap teeth (6) of the stop bar (1) with a tool, and the steel pricker (5) inserted in the coal wall (13) is pulled out;

4) using a hanging device (10) is used to hang the stop bar (1) on the forepoling bar (4), and then next driving cycle is performed.

4. The supporting method of a driving face of a large-section coal roadway according to claim 3, characterized in that a precise number of the wall-caving-resistant stop bars is determined according to surrounding rock status and large and small temporary supporting devices for a heading face section; in an area where the coal wall (13) is unstable, wood plates (12) or steel plates are configured to be arranged between the stop bars (1) as appropriate to increase the stressed area and guarantee the stability of the coal wall (13).

* * * * *